US005671569A

United States Patent [19]

Kobori et al.

[11] Patent Number: 5,671,569

[45] Date of Patent: Sep. 30, 1997

[54] SEISMIC RESPONSE CONTROLLED FRAME OF BENDING DEFORMATION CONTROL TYPE

[75] Inventors: Takuji Kobori; Yukihiro Omika; Masayuki Nagata; Jun Okawa; Yukimasa Yamamoto, all of Tokyo, Japan

[73] Assignee: Kajima Corporation, Tokyo, Japan

[21] Appl. No.: 564,408

[22] Filed: Nov. 29, 1995

[30] Foreign Application Priority Data

Jun. 8, 1995 [JP] Japan ..... 7-141784
Jun. 16, 1995 [JP] Japan ..... 7-150067

[51] Int. Cl.[6] ..... E04B 1/98

[52] U.S. Cl. ..... 52/167.6; 52/167.2

[58] Field of Search ..... 52/167.2, 167.6, 52/167.1

[56] References Cited

U.S. PATENT DOCUMENTS 3,638,377 2/1972 Caspe ..... 52/167.6 X
3,940,895 3/1976 Yamamoto et al. ..... 52/167.1
4,635,892 1/1987 Baker ..... 52/167.2 X
5,036,633 8/1991 Kobori et al. ..... 52/167.2 X

*Primary Examiner*—Carl D. Friedman
*Assistant Examiner*—Creighton Smith
*Attorney, Agent, or Firm*—Pearne, Gordon, McCoy & Granger LLP

[57] ABSTRACT

In a multi-storied frame building, a controlled frame member having means to damp seismic forces of deformation. A first vertical wall column has a top connected to a horizontal wall girder overhanging the wall column. A second wall column is erected in vertical alignment beneath the tip end of the wall girder co-planar with, but spaced from, the first wall column. A seismic response control apparatus connected between the tip end of the wall girder and the top of the second wall column generates damping force when the tip end of the wall girder and the top of the second wall column are displaced relative to each other. Additional girders are arranged on lower stories of the building as required to further strengthen the building against seismic deformation.

21 Claims, 15 Drawing Sheets

SEISMIC RESPONSE CONTROLLED FRAME OF BENDING DEFORMATION CONTROL TYPE

BACKGROUND OF THE INVENTION

1. Field of the Invention

This invention relates to a seismic response controlled frame of bending deformation control type, which can enhance the degree of freedom of an architectural design by reducing the bending deformation of a frame caused by seismic or wind forces.

2. Description of the Prior Art

When a frame of a building is constructed of a core composed of earthquake resisting elements and an outer frame around the core, the core sustains the brunt of horizontal seismic forces in view of a difference in stiffness. Thus, the deformation of the core is critical when the frame is deformed due to seismic force or wind pressure, since the frame has a tendency to adopt a permanent deformation due to bending, which is magnified in multi-storied buildings. Thus, it is important for the design of a multi-storied building to reduce the deformation of the core.

The deformation of the core due to bending can be reduced by increasing the rigidity of the whole frame, including the outer frame. However, if the frame is designed to share the horizontal force equally between the core and the outer frame by increasing the stiffness of the whole frame, seismic force excessively impacts the outer frame. On the other hand, if the frame is designed to burden the core with most of the seismic force by separating the core and the outer frame, a tipping moment excessively acts on legs of the core. Thus, it is necessary to increase the stiffness of lower stories to minimize tipping of the core legs. This increases the difficulty of designing the building frame.

The present applicant has previously proposed a structure which effectively reduces the bending deformation of a core, on the basis of the background described above (See Japanese Patent Application No. 5-168787.)

SUMMARY OF THE INVENTION

It is an object of the present invention to provide a seismic response controlled frame which is derived from the already applied invention described above so as to further enhance the degree of freedom of an architectural design.

According to the present invention, a basic seismic response controlled frame comprises a wall column composed of an earthquake resisting element having a top connected to a wall girder horizontally overhanging from the top, i.e., cantilevered, and a connection column erected from a position corresponding to the tip or cantilevered end of the wall girder planar and isolated from the wall girder, or a pair of mutually confronting wall columns provided with an earthquake resisting element connected to the wall girder. Thus, columns and beams in a building are respectively concentrated in the wall columns and the wall girders which form the core of the building, whereby the degree of freedom of architectural design can be enhanced.

According to the basic seismic response controlled frame, the wall column including the wall girder bears most of the seismic force within a building, and the wall column is deformed due to bending when bearing the seismic force.

A seismic response control apparatus is connected to both the wall girder and the connection column, which are isolated from each other, or both the wall girders isolated from each other, and generates damping force when the wall girder and the connection column or the wall girders are displaced relative to each other. The seismic response control apparatus controls the displacement of the tip end of the wall girder to reduce the bending deformation of the wall column when the wall column constituting the core is deformed due to bending.

Since the wall column bears most of the seismic force, the bending deformation and the tipping moment acting on the legs are liable to increase. However, since the damping force corresponding to the deformation is applied from the seismic response control apparatus to the wall column, the wall column is restrained from increasing the deformation. Thus, the deformation of the wall column can be reduced. Further, when the wall column is deformed, the bending moment reverse to the tipping moment is applied from the seismic response control apparatus to the wall column to cope with the tipping moment with safety.

Further, beams are arranged on the lower stories to construct a rigid frame with a wall column and an outer wall, or only with the outer wall, while upper stories are constructed with the wall column and an outer frame or only with the outer wall. Otherwise a girder is arranged on one of the lower stories to construct a frame with the wall column and the outer frame, or with the outer wall and the column. By so doing, the bending stiffness of the lower stories of the frame can be enhanced to enable construction of higher multi-stories buildings without enlarging the shearing section of the wall columns.

A plurality of basic seismic response controlled frames are combined in a plurality of directions to construct a composite seismic response controlled frame or an earthquake resisting frame to support a building frame.

When no beam or girder is arranged on the lower stories, slabs are connected to the part of the wall columns of the composite seismic response controlled frame, and a support for supporting the upper slab is arranged between the upper and lower slabs to construct a frame completed as a building. The wall column bears a horizontal load and most of the vertical load of the slab, and the support bears part of the vertical load of the slab.

According to the composite seismic response controlled frame, since the columns and beams are also concentrated in the wall columns and the wall girders, the columns and the beams on each story are respectively eliminated from the frame completed as the building. Thus, a space free from columns and beams is defined in the building except the core, allowing greater freedom of planning. Besides, the height of story can be reduced in comparison with that of the rigid frame.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
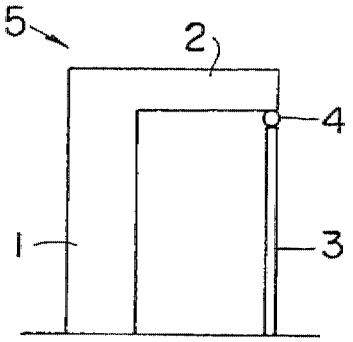
FIG. 1 is a schematic elevation showing the most basic seismic response controlled frame according to the present invention.

As shown in FIGS. 1 to 7, a seismic response controlled frame 5 according to the present invention comprises a wall column 1 composed of an earthquake resisting element having a top connected to a wall girder 2 horizontally overhanging, or cantilevered, from the top, a connection column 3 erected from the position corresponding to the tip end of the wall girder 2 planar and isolated from the wall girder 2, and a seismic response control apparatus 4 connected to both the tip end of the wall girder 2 and the top of the connection column 3 to generate damping force when the tip end of the wall girder 2 is displaced relative to the top of the connection column 3. The seismic response controlled frame 5 is provided as the most basic unit in a seismic response controlled structure, in which seismic vibrations are controlled by the seismic response control apparatus 4.

Figure 2:
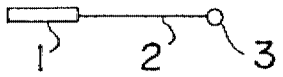
FIG. 2 is a schematic plan view of FIG. 1.
Figure 4:
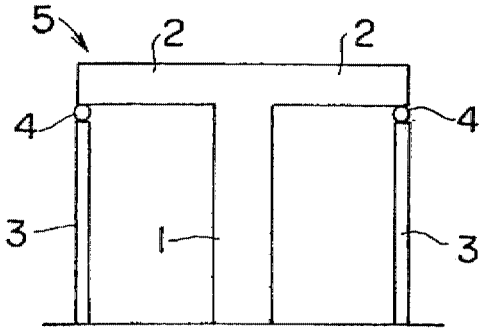
FIG. 4 is a schematic elevation showing a seismic response controlled frame including wall girders connected to both sides of a wall column.
Figure 5:
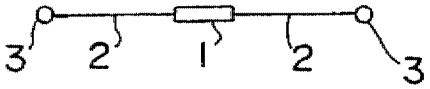
FIG. 5 is a plan view of FIG. 4.
Figure 6:
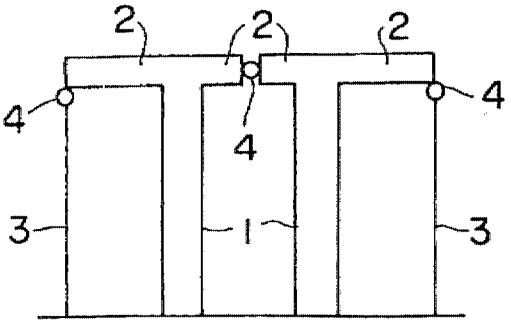
FIG. 6 is a schematic elevation showing a seismic response controlled frame of a type in which two seismic response controlled frames are shown connected together.
Figure 7:
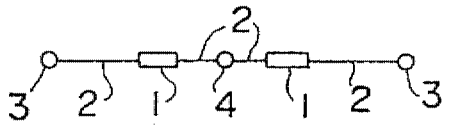
FIG. 7 is a plan view of FIG. 6.

FIGS. 1 and 2 show a seismic response controlled frame in which the wall girder 2 is cantilevered from one side of the wall column 1. FIGS. 4 and 5 show a seismic response controlled frame of a type in which the wall girder 2 is cantilevered from both sides of the wall column 1. FIGS. 6 and 7 show a seismic response controlled frame of a type in which two seismic response controlled frames 5, 5, shown in FIGS. 4 and 5, are planar and connected together through the seismic response control apparatus 4 arranged between the mutually connected wall girders 2, 2 without providing the connection columns 3 on the outboard sides of each seismic response controlled frame. FIGS. 2, 5 and 7 are plan views of each seismic response controlled frame shown in FIGS. 1, 4 and 6, respectively. Incidentally, in FIGS. 2, 5 and 7, the rectangle represents the wall column 1, a solid line represents the wall girder 2, and a circle represents the connection column 3.

Figure 39:
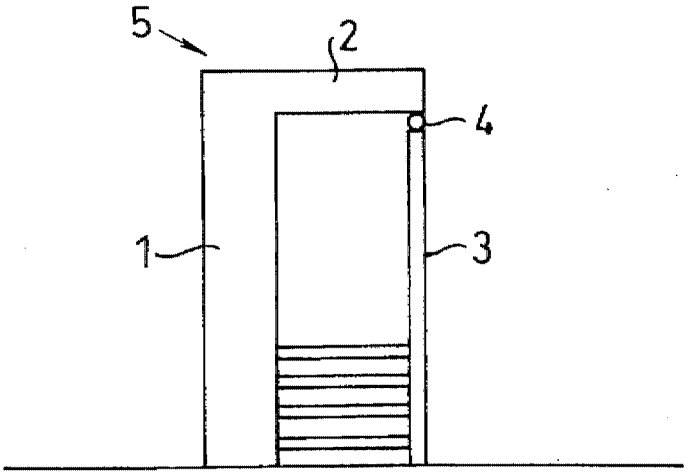
FIG. 39 is a schematic view showing a seismic response controlled frame including beams arranged on lower stories of the seismic response controlled frame.
Figure 40:
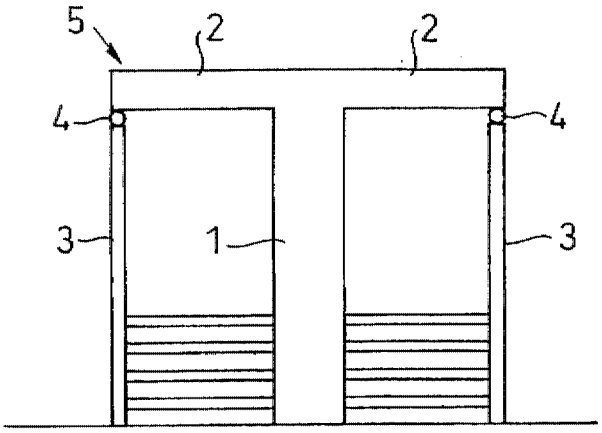
FIG. 40 is a schematic view showing a seismic response controlled frame including beams arranged on lower stories of the seismic response controlled frame.
Figure 41:
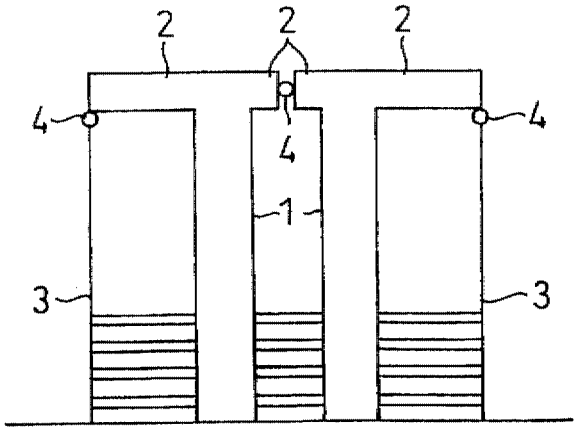
FIG. 41 is a schematic view showing a seismic response controlled frame including beams arranged on lower stories of the seismic response controlled frame.

As shown in FIGS. 39, 40 and 41, a seismic response controlled frame further comprises beams arranged on the lower stories in order to enhance the stiffness of the lower stories.

Figure 43:
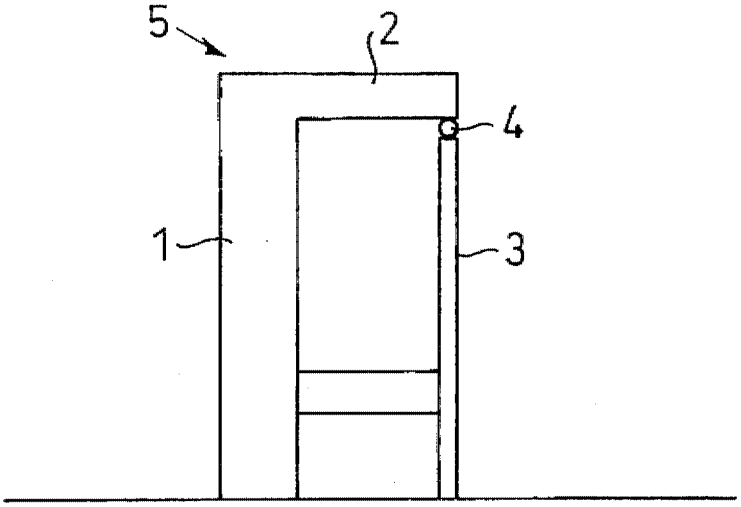
FIG. 43 is a schematic elevational view showing a seismic response controlled frame including a girder arranged on one story of the seismic response controlled frame.
Figure 44:
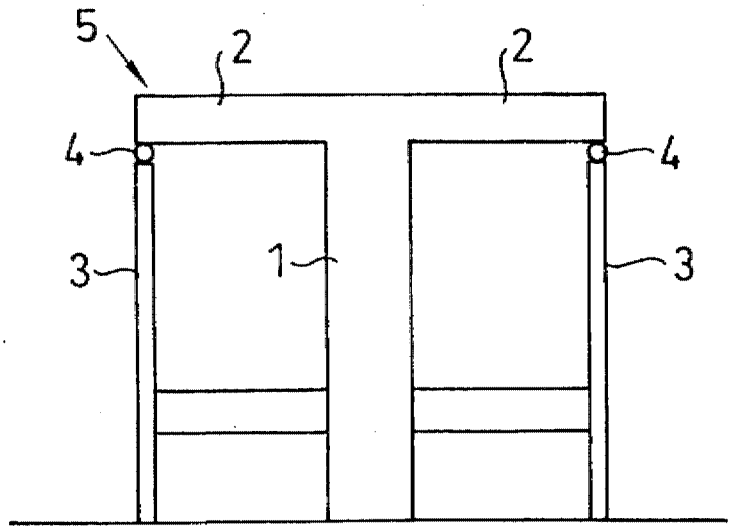
FIG. 44 is a schematic elevational view showing a seismic response controlled frame including a modified girder arranged on one story of the seismic response controlled frame.
Figure 45:
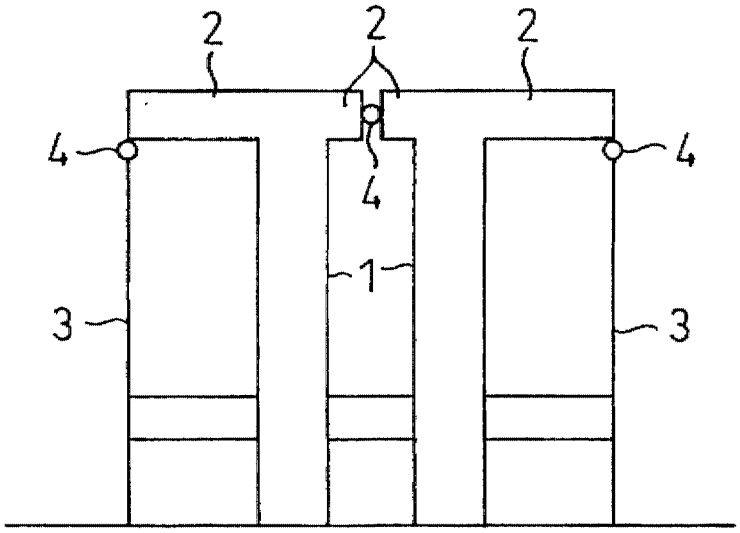
FIG. 45 is a schematic elevational view showing a seismic response controlled frame including a modified girder arranged on one story of the seismic response controlled frame.
Figure 46:
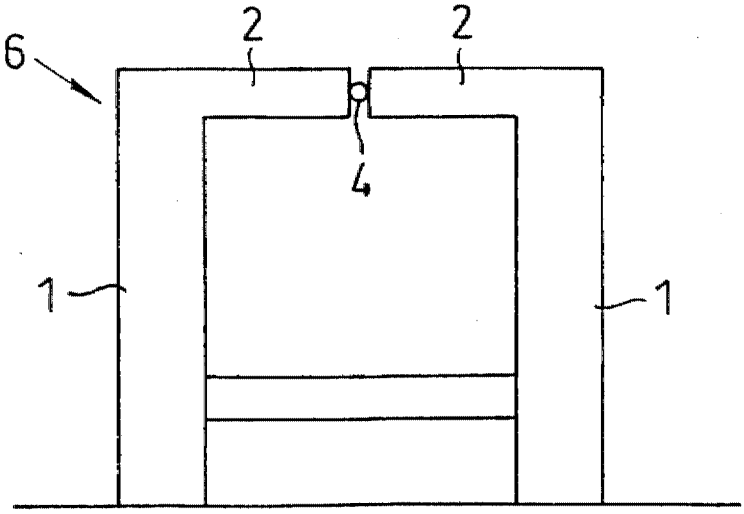
FIG. 46 is a schematic elevational view showing a seismic response controlled frame including a modified girder arranged on one story of the seismic response controlled frame.

As shown in FIGS. 43, 44 and 45, a seismic response controlled frame according to the present invention further comprises a girder arranged on one lower story to construct a rigid frame. Thus, the seismic response controlled frames shown in FIGS. 43, 44 and 45 enhance the bending stiffness of the lower story of a multi-storied building.

Figure 8:
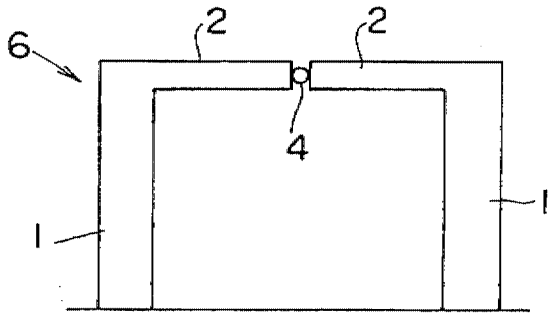
FIG. 8 is a schematic elevation of a seismic response controlled frame according to the present invention showing opposed girders interconnected with a passive mass damper.
Figure 9:
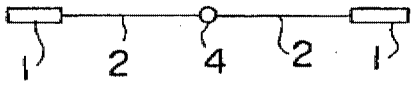
FIG. 9 is a plan view of FIG. 8.

As shown in FIGS. 8 and 9, a seismic response controlled frame 6 according to the present invention comprises a pair of wall columns 1, 1, each composed of an earthquake resisting element having a top connected to a wall girder 2 horizontally overhanging from the top, the wall girders 2 of the pair of wall columns confronting each other, and a seismic response control apparatus 4 connected to both the tip ends of the wall girders 2, 2 of the wall columns 1, 1 to generate damping force when the tip ends of the wall girders 2, 2 are displaced relative to each other.

The wall column 1 and the wall girder 2 in the seismic response controlled frame 5 (or 6) is built in box-frame type reinforced concrete construction, steel-structured brace construction, or other construction which is easily deformed due to bending as a whole. In the illustrated embodiment, an axis of the wall girder 2 is on the same level as a plane of the wall column 1, including the axis thereof. However, the axis of the wall girder 2 is placed at an angle with respect to the plane of the wall column 1, including the axis thereof in some cases.

Figure 3:
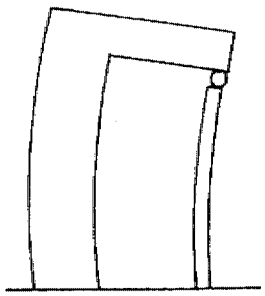
FIG. 3 is an elevation showing the deformed state of the seismic response controlled frame shown in FIG. 1.

When seismic force acts on the seismic response controlled frame 5 shown in FIG. 1, the wall column 1 having high rigidity bears most of the seismic force. In this case, the wall column 1 is insulated from the connection column 3, and then deformed due to bending as shown in FIG. 3 without suffering restriction by direct deformation. At this time, the vibrations of the wall column 1 are damped by the seismic response control apparatus 4 arranged between the wall girder 2 and the connection column 3, and simultaneously, the wall column 1 receives the reaction force reverse to the deformation force from the seismic response control apparatus 4 to reduce the tipping moment.

Figure 10:
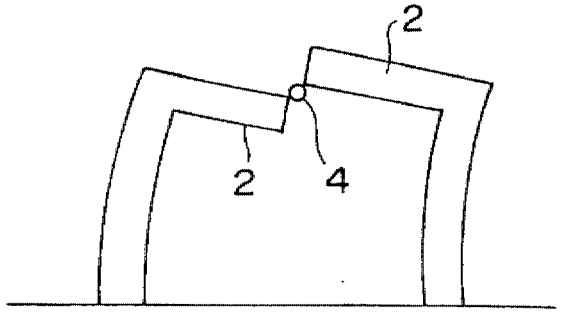
FIG. 10 is a schematic elevation showing the deformed state of the seismic response controlled frame shown in FIG. 8.

The seismic response controlled frame 6 shown in FIG. 8 is deformed as shown in FIG. 10 due to the deformation of each wall column 1 in the same direction, and the vibrations of each wall column 1 are damped by the seismic response control apparatus 4, similar to the seismic response controlled frame 5. In this case, one of the pair of wall columns 1 receives the reaction force reverse to the deformation from the other wall column 1.

Figure 42:
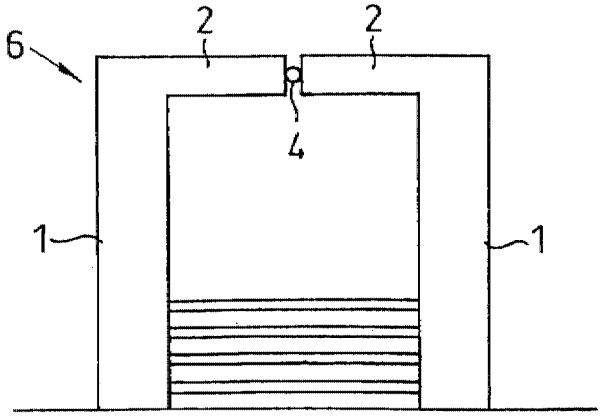
FIG. 42 is a schematic view showing a seismic response controlled frame including beams arranged on lower stories of the seismic response controlled frame.

A seismic response controlled frame according to the present invention also enhances the bending stiffness of the lower stories of a multi-storied seismic response controlled frame. FIGS. 40, 41, and 42 show seismic controlled frames with reinforced lower floors.

Figure 37:
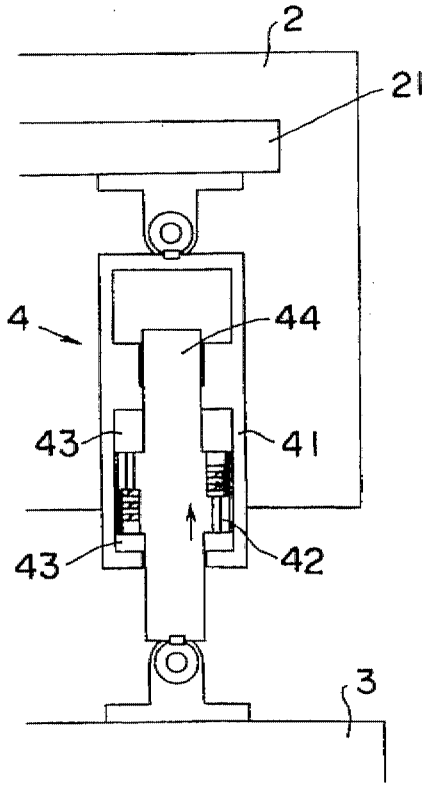
FIG. 37 is an elevation showing a hydraulic seismic control device used in a preferred embodiment of the invention when the device is in the expanded condition.

As shown in FIG. 37, the seismic response control apparatus 4 comprises an oil-hydraulic cylinder 41 having oil-hydraulic chambers 43, 43 on both sides of a piston 42, and a piston rod 44 reciprocating within the oil-hydraulic cylinder 41. The basic principle of the seismic response control apparatus 4 is that resistance force caused by the migration of pressure oil between the chambers 43, 43 is applied as damping force. The oil-hydraulic cylinder 41 and the piston rod 44 are respectively connected to the wall girder 2 and the connection column 3, such as to be capable of lineal displacement relative to each other. When the wall girder 2 and the connection column 3 or the wall girders 2, 2 are displaced relative to each other, the piston rod 44 is moved relative to the oil-hydraulic cylinder 41 to generate damping force.

Figure 30:
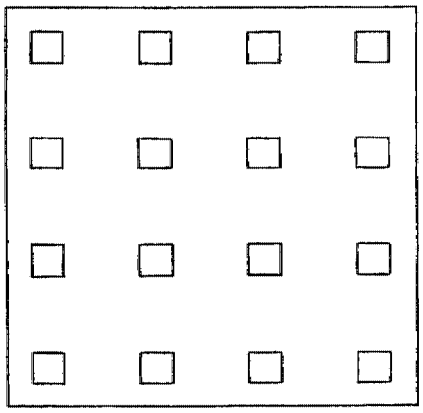
FIG. 30 is a schematic plan view showing the wall columns of a rigid frame building.

As shown in FIGS. 11 through 16, composite seismic response controlled frame 7 according to the present invention comprises a plurality of seismic response controlled frames 5 (or 6) arbitrarily selected from a group consisting of the plurality of seismic response controlled frames 5 and the plurality of seismic response controlled frames 6, wherein the plurality of seismic response controlled frames 5 (or 6) thus selected are combined together in a plurality of directions. The wall columns 1 of the combined seismic response controlled frames 5 (or 6) form a core. The wall columns 1 of the composite seismic response controlled frames 7 forming the core are equivalent in form to the concentrated columns in a rigid frame structure, as shown in FIG. 30.

Figure 11:
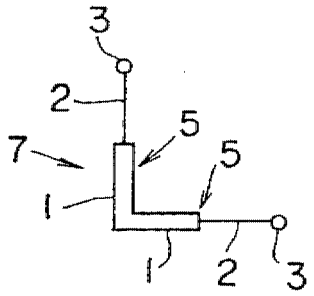
FIG. 11 is a schematic plan view showing a composite seismic response controlled frame of a type in which two seismic response controlled frames are combined together, according to the present invention.
Figure 12:
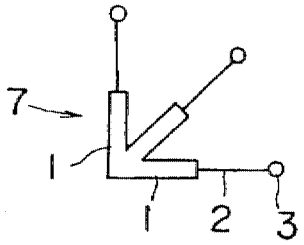
FIG. 12 is a schematic plan view showing a composite seismic response controlled frame of a type in which the L-shaped frame of FIG. 11 is bifurcated to provide a third frame.
Figure 13:
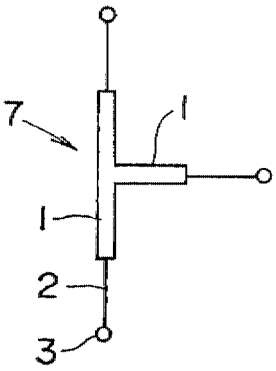
FIG. 13 is a schematic plan view showing a composite seismic response controlled frame of another type, in which the frame is T-shaped.
Figure 14:
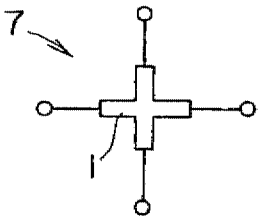
FIG. 14 is a schematic plan view showing a composite seismic response controlled frame of a type in which the frame is cruciform shaped.
Figure 15:
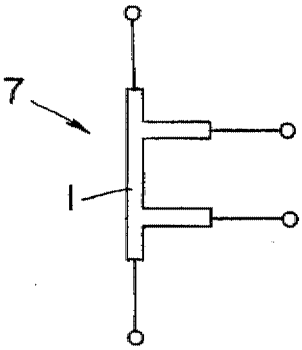
FIG. 15 is a schematic plan view showing a composite seismic response controlled frame of another type in which the frame is channel shaped.
Figure 16:
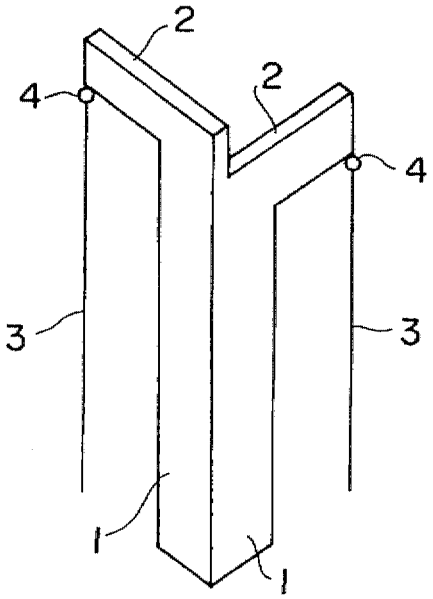
FIG. 16 is a perspective view showing a composite seismic response controlled frame which has a difference in level between orthogonal wall girders.

Specifically, FIG. 11 shows the L-shaped configuration of the composite response controlled frame 7 including two seismic response controlled frames 5 (or 6) combined orthogonally and planar to each other. FIG. 12 shows the bifurcated L-shaped configuration of the composite seismic response controlled frame 7 including three seismic response controlled frames 5 (or 6) combined together. FIG. 13 shows the T-shaped configuration of the composite seismic response controlled frames 5 (or 6) combined together. FIG. 14 shows the cruciform-shaped configuration of the composite seismic response controlled frame 7 including two or four seismic response controlled frames 5 (or 6) combined together. The seismic response controlled frames 5 (or 6) are joined together rigidly at portions of the wall columns 1, 1. Incidentally, two seismic response controlled frames are not always combined together horizontally planar and aligned. FIG. 16 shows a case where the combined seismic response controlled frames 5 (or 6) have a difference in horizontal level between the wall girders 2, 2.

FIGS. 17 to 24 show arrangements of the composite seismic response controlled frames 7 to form various configured earthquake resisting building cores.

Figure 17:
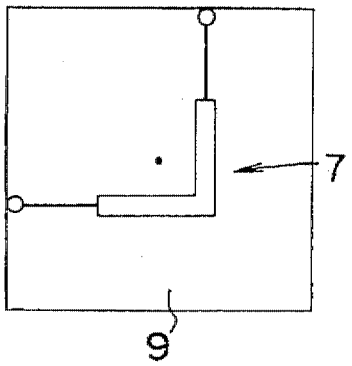
FIG. 17 is a schematic plan view showing an arrangement of the composite seismic response controlled frame in a building according to the present invention.

FIG. 17 shows the arrangement of the composite seismic response controlled frame 7 as the minimum unit including two seismic response controlled frames 5 (or 6) orthogonally combined together. According to the arrangement shown in FIG. 17, as long as the center of rigidity of the wall columns 1 of the composite seismic response controlled frame 7 is coincident with the center of gravity of the building to reduce the torsion of the building, the earthquake resisting frame can be theoretically realized by a combination of two seismic response controlled frames 5 (or 6).

Figure 18:
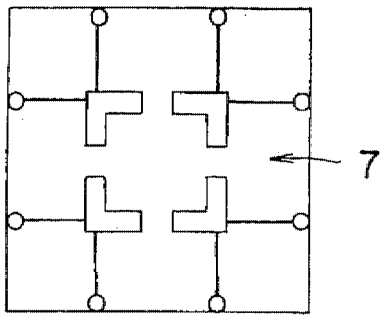
FIG. 18 is a schematic plan view showing the arrangement of composite seismic response controlled frames which form a square core.
Figure 19:
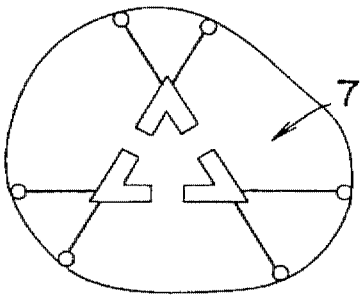
FIG. 19 is a schematic plan view showing the arrangement of composite seismic response controlled frames which form a triangular core.

In this case, even if the earthquake resisting frame is theoretically realized, there is a possibility that the earthquake resisting frame loses balance due to cracks or the like caused in the wall column 1 or the like. Thus, if the horizontal balance in two directions is taken into consideration, it is rational to combine four sets of composite seismic response controlled frames 7 of FIG. 17 together, as shown in FIG. 18. It is possible to form a triangular core, and balance and safety can be ensured by a combination of three sets of composite seismic response controlled frames 7, each of which is composed of two seismic response controlled frames 5 (or 6) combined together at an angle of 60°, as shown in FIG. 19.

Figure 20:
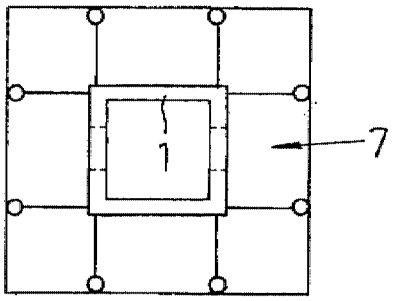
FIG. 20 is a schematic plan view showing the arrangement of composite seismic response controlled frames which form a closed square core.

As shown in FIG. 20, the earthquake resisting frame can be realized even when the composite seismic response controlled frames 7 are combined together such that the core is defined by the wall columns 1, 1, in a closed square shape, instead of an L-like shape. In this case, an opening shown by a broken line is provided in the wall column for utilizing the inside of the core. However, it is possible to ensure the performance as an earthquake resisting element by varying the position of the opening on each story.

Figure 21:
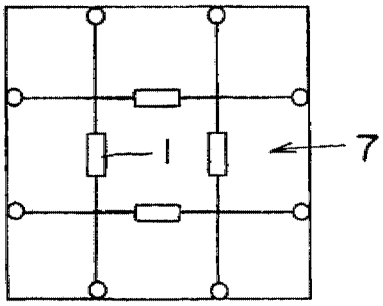
FIG. 21 is a schematic plan view showing another arrangement of composite seismic response controlled frames which form a square core.
Figure 25:
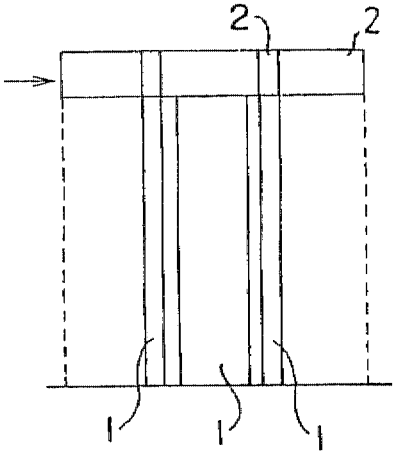
FIG. 25 is a schematic elevation showing an inventive frame prior to deformation due to seismic force.
Figure 25A:
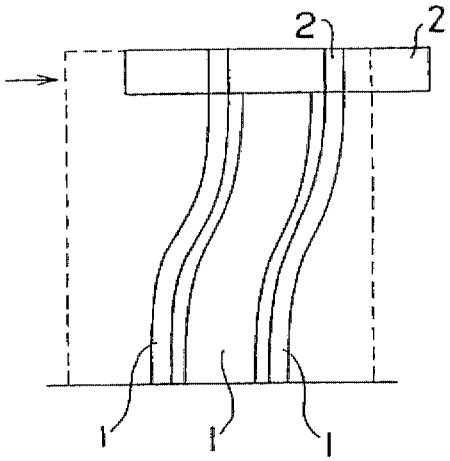
FIG. 25A is a schematic elevation showing the mode of deformation when the orthogonal wall girders of the composite seismic response controlled frame of FIG. 25 are on the same level.
Figure 26:
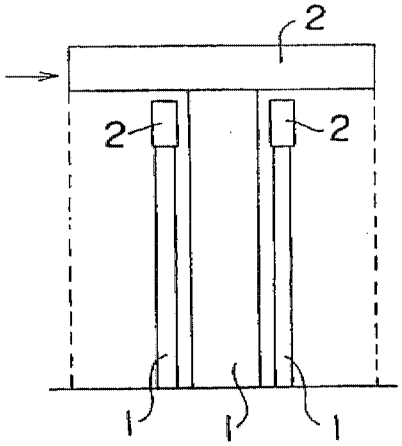
FIG. 26 is a schematic elevation showing an inventive frame with bi-level girders.
Figure 26A:
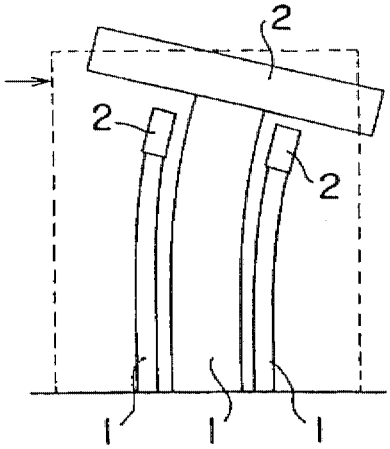
FIG. 26A is a schematic elevation showing the mode of deformation when the composite seismic response controlled frame of FIG. 26 is subjected to seismic force.
Figure 27:
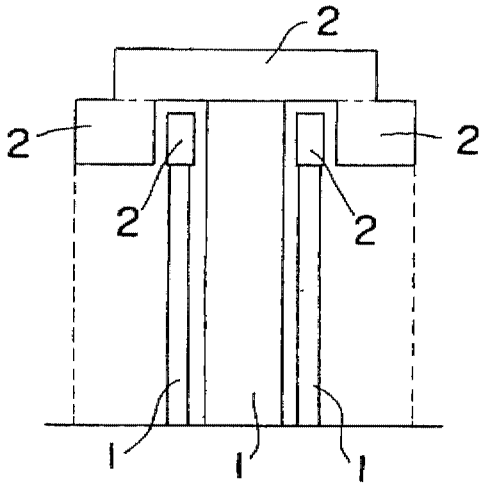
FIG. 27 is a schematic elevation showing the state of the composite seismic response controlled frame which has a difference in levels between opposite portions of the wall girders.

As shown in FIG. 21, when the composite seismic response controlled frames 7 are combined together such that the two-directional wall columns 1, 1 are arranged in a square shape, the two-directional wall girders 2, 2 located on the uppermost portion are arranged to be flush with each other. In this case, the wall girder 2 in the direction orthogonal to the direction of deformation restricts the deformation of the wall girder 2 in the direction of deformation, and as a result, the composite seismic response controlled frame 7 is subjected to shearing deformation as shown in FIG. 25A, which is contrary to the object of the present invention. Thus, it is necessary to set a difference in level between the orthogonal wall girders 2, 2 as shown in FIGS. 26 and 26A. It is also conceivable that a difference in level can be set between portions of any one-directional wall girder 2 on both sides of the wall column 1, as shown in FIG. 27.

Figure 22:
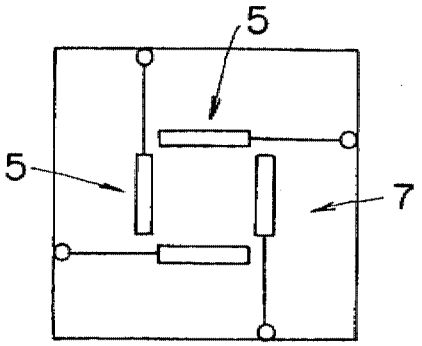
FIG. 22 is a schematic plan view showing the arrangement of composite seismic response controlled frames as a modification of FIG. 21.
Figure 23:
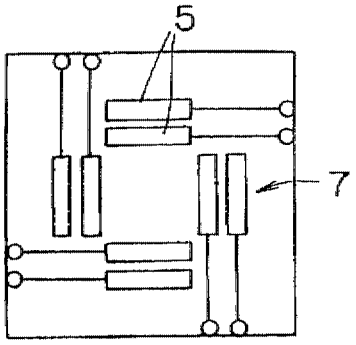
FIG. 23 is a schematic plan view showing the configuration of composite seismic response controlled frames, in which a pair of seismic response controlled frames in each direction are arranged in parallel, as a modification of FIG. 22.

When the two-directional wall columns 1, 1 are arranged in a square, it is not necessary to set the difference in level between the wall girders 2, 2, as long as the mutually orthogonal wall girders 2, 2 are arranged without interference, as shown in FIG. 22.

Figure 24:
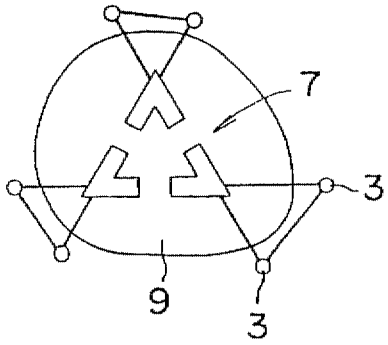
FIG. 24 is a schematic plan view showing the configuration of composite seismic response controlled frames, in which connection columns are arranged on the outside of a slab, as a modification of FIG. 19.

If the connection column 3 is separated from the building independently, the connection column 3 can be arranged on the outside of a slab 9 as shown in FIG. 24. In this case, the mutually adjacent connection columns 3, 3 are interconnected.

Figure 28:
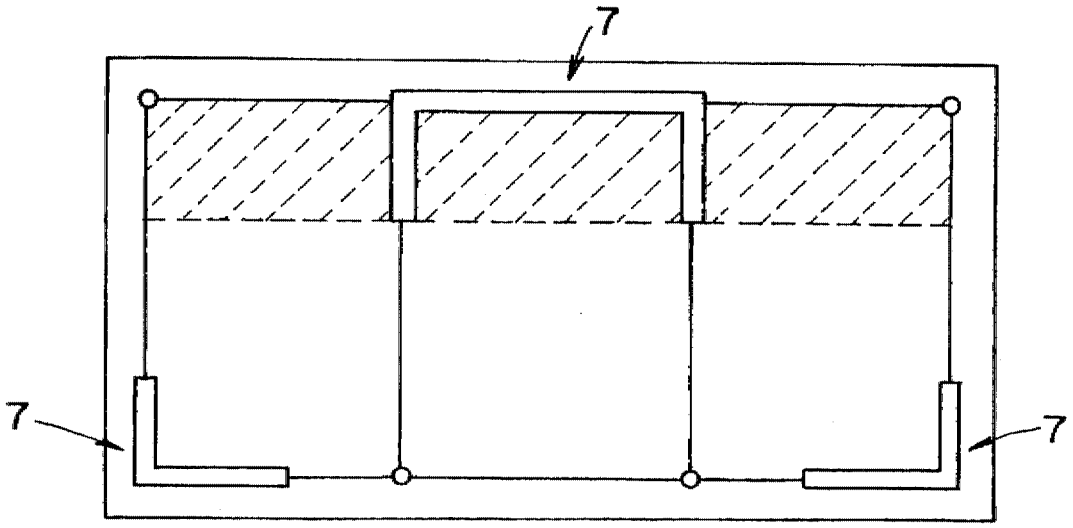
FIG. 28 is a schematic plan view showing the formation of a single side core as an embodiment of the invention.
Figure 29:
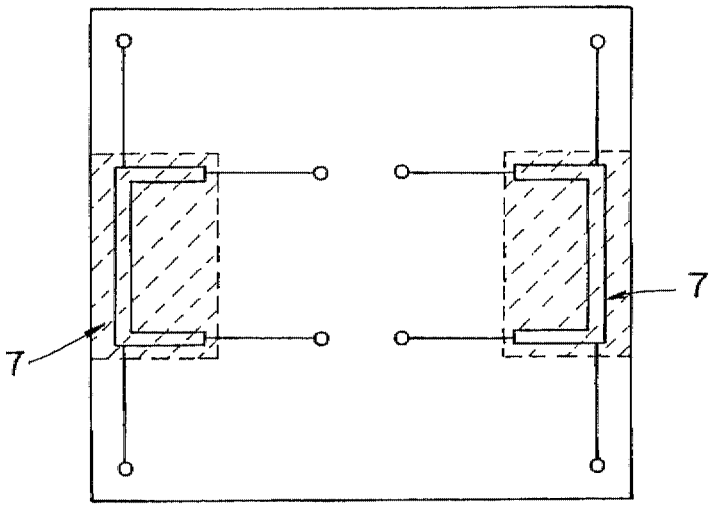
FIG. 29 is a schematic plan view showing the formation of a double side core as an embodiment of the invention.

FIGS. 28 and 29 show a case where an earthquake-resisting frame having small torsion is constructed by a combination of the composite seismic response controlled frames 7, which are approximately equal in wall values in two directions and make the center of gravity coincident with the center of rigidity. FIG. 28 shows an embodiment of a single side core, and FIG. 29 is an embodiment of a double side core. In the drawings, a hatch portion of broken lines represents a core.

Figure 30A:
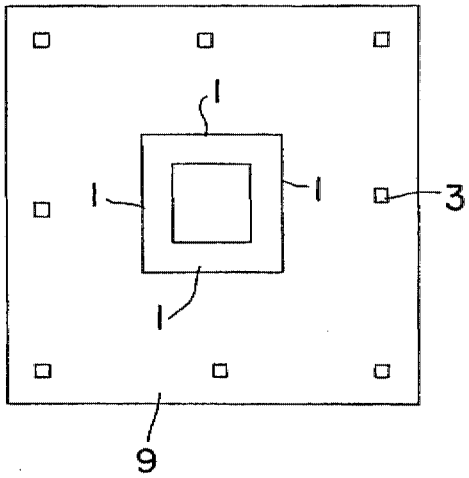
FIG. 30A is a schematic plan view showing the wall columns according to the subject invention.

FIGS. 30 and 30A show the difference between a standard frame building and the inventive frame building.

Figure 31:
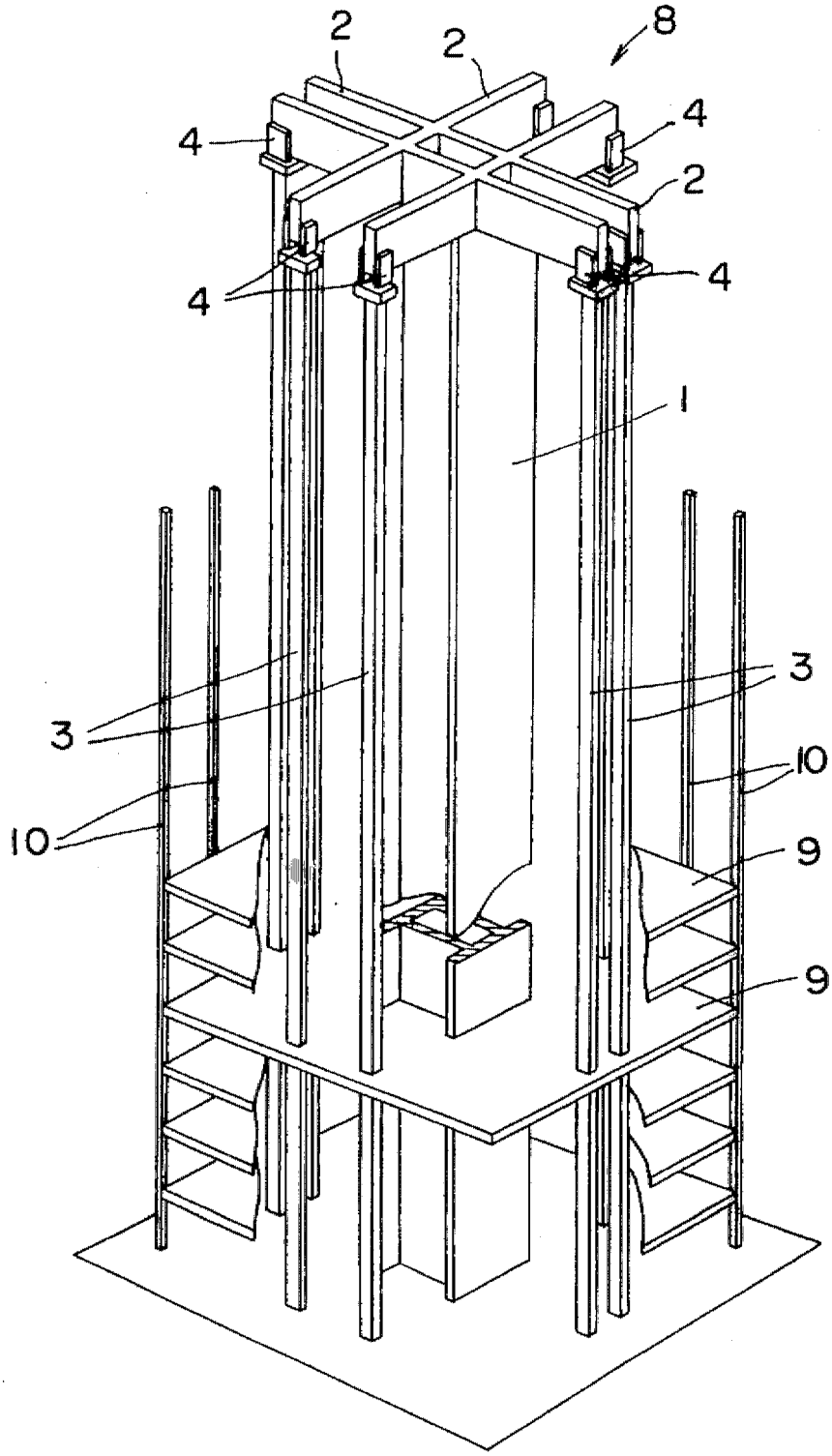
FIG. 31 is a perspective view showing the configuration of a seismic response controlled frame according to the present invention.

As shown in FIG. 31, a seismic response controlled frame 8 according to the present invention comprises the composite seismic response controlled frame 7, slabs 9 arranged on lower stories of the composite seismic response controlled frame 7 and connected to a part of a core composed of the wall columns 1 in case of having no beam and girder, and supports 10 arranged between the upper and lower slabs 9, 9 to support the upper slab 9. The seismic response controlled frame 8 constructs a frame which is completed as a building.

Figure 34:
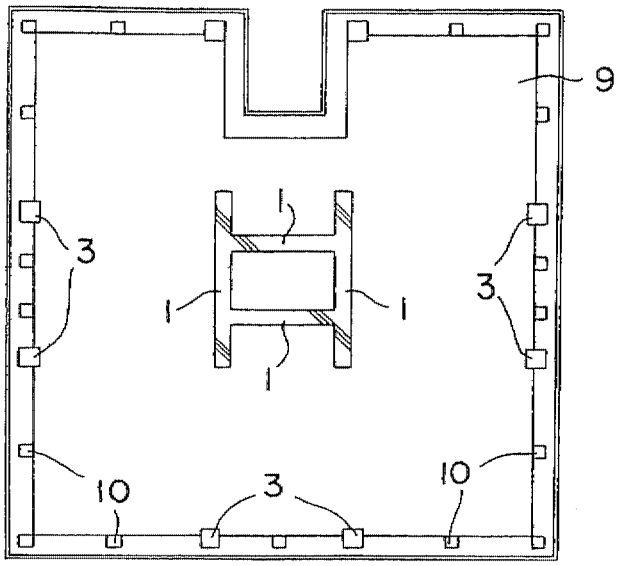
FIG. 34 is a schematic plan view of the frame shown in FIG. 31.

The support 10 is a column having a function of supporting the periphery of the slabs 9 at each story. For instance, as shown in FIG. 34, even when a well or a concave portion is defined in the plane of the slab, the support 10 may bear only a part of the vertical load of the slab 9. Thus, since the support does not need to function as an earthquake resisting element, the support does not exert an influence in planning on the composite seismic response controlled frame 7 which serves as the earthquake resisting element. Further, since the support 10 does not exert an influence on the earthquake resisting element with the variation of height of each story, it can be applied to a general purpose building, which varies the height of story depending on the purpose, such as residence, office and commercial facilities.

Figure 33:
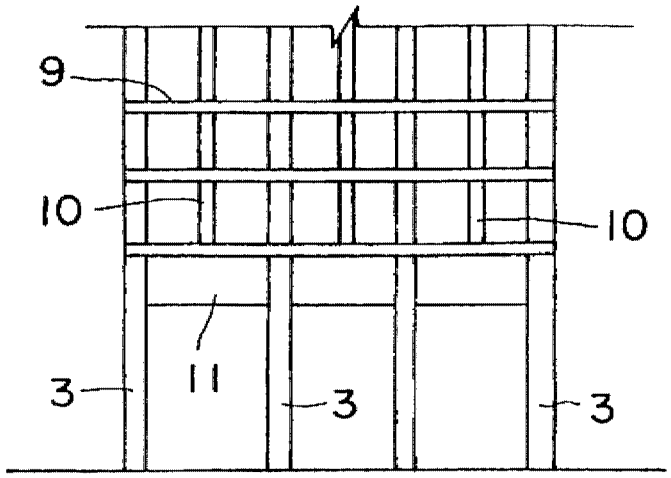
FIG. 33 is a schematic elevation showing the story of a building from which supporting columns are eliminated according to the present invention.

Further, since the support 10 only supports the slab 9 of each story, there is a possibility that the support 10 is absent in some stories, as shown in FIG. 33. However, in this case, a bearing beam 11 is laid on a lower end of the support 10 so as to transfer the load, which otherwise would be borne by the support 10, to the connection column 3.

Figure 35:
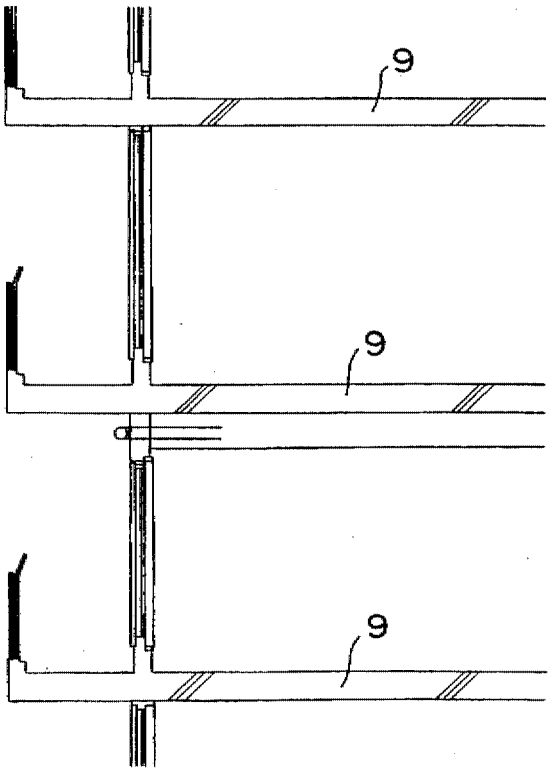
FIG. 35 is a fragmentary sectional view of FIG. 34.

FIG. 34 is a plan view of FIG. 31 and FIG. 35 is a sectional view of FIG. 31. It will be noted that there are no support columns between the core and the outer wall, thereby removing many restrictions in planning floor space that were inherent in conventional standard frame buildings. Further, restriction in elevational planning is also reduced. Thus, the height of each story can be modified so as to ensure equal ceiling height.

Figure 32:
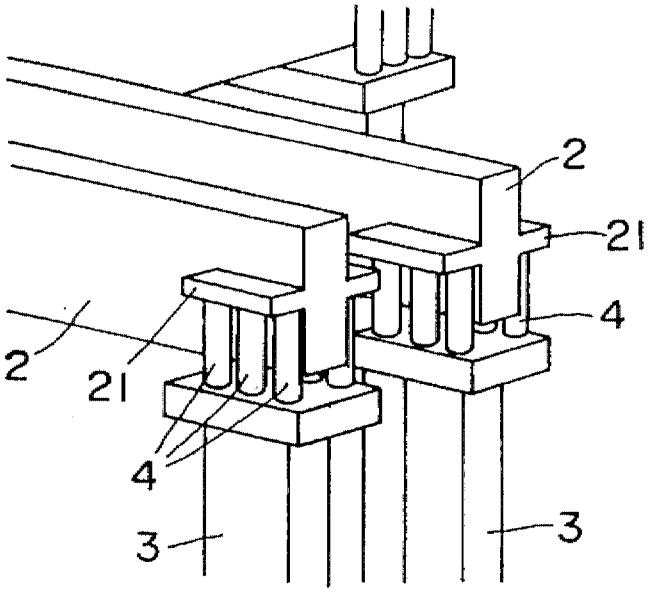
FIG. 32 is a fragmentary enlarged scale perspective view of FIG. 31.

FIG. 32 is an enlarged scale view showing a location of the seismic response control apparatus shown in FIG. 31. As shown in FIG. 32, the seismic response control apparatus 4 is installed between the free end of the wall girder 2 and the top of the connection column 3. Practically, a plurality of seismic response control apparatuses can be arranged uniformly on both sides of each wall girder 2 in order to attain the optimum damping effect. A support portion 21 for supporting the seismic response control apparatus 4 projects laterally from both sides of the wall girder 2. As described above, both ends of the seismic response control apparatus 4 are connected to both the wall girder 2 and the connection column 3 so as to be capable of relative displacement.

Figure 36:
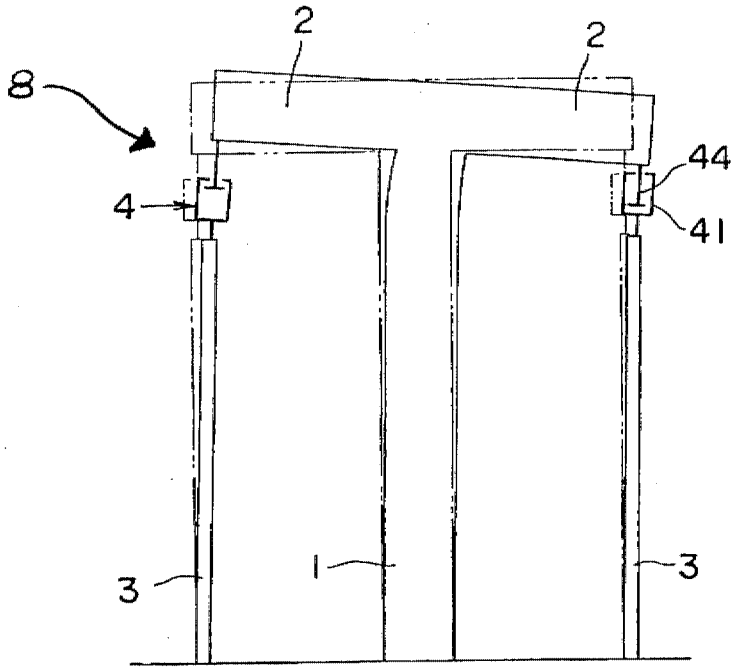
FIG. 36 is a schematic elevation showing in phantom the mode of deformation of the seismic response controlled frame shown in FIG. 31.

FIG. 36 shows the state of the seismic response controlled frame 8 when deformed. At this time, the tip end of the wall girder 2 on the side of deformation in the seismic response controlled frame 8 is rotationally displaced close to the connection column 3, and the tip end of the opposite wall girder 2 to that on the side of deformation is displaced apart from the connection column 3. However, since the seismic response control apparatus 4 is connected to both the wall girder 2 and the connection column 3 such as to be capable of displacement relative to each other, the seismic response control apparatus 4 follows the relative displacement. In this case, the seismic response control apparatus 4 is contracted or extended to apply reaction force reverse to the displacement to the wall girder 2, while restraining the displacement of the wall girder 2.

Figure 38:
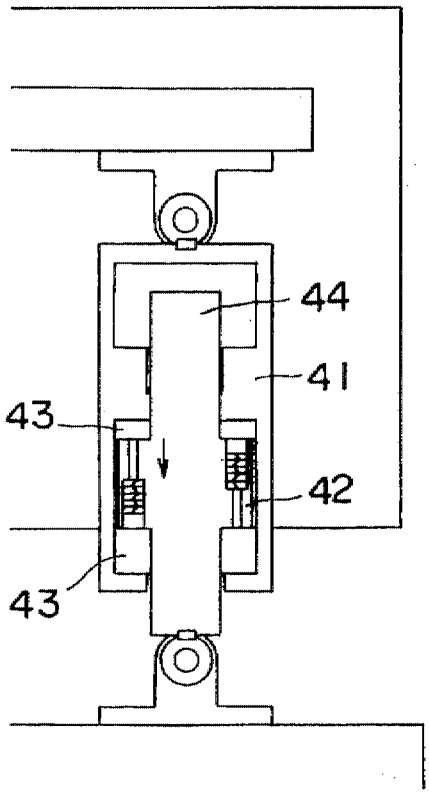
FIG. 38 is an elevation showing a hydraulic seismic response control device used in a preferred embodiment of the invention when the device is in the contracted condition.

FIGS. 37 and 38 respectively show the state of the seismic response control apparatus when the wall girder 2 and the connection column 3 are displaced away from each other and that when the wall girder 2 and the connection column 3 are displaced toward each other. As described above, since the seismic response control apparatus 4 generates the resistance force caused by the migration of pressure oil between the oil-hydraulic chambers 43, 43 as damping force, the seismic response control apparatus 4 can generate the damping force even when the pressure oil is caused to migrate in any direction.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

What is claimed is:

1. In a multi-storied frame building, a seismic force response controlled frame, comprising:

a first column having a top connected to a cantilevered wall girder having at least one tip end horizontally extending from said top of said first column;

a second column in alignment with said tip end of said wall girder and spaced therefrom; and a passive mass damper connected between the tip end of said wall girder and said second column to damp displacement of said tip end of said wall girder by generating damping force when said tip end of said wall girder and said second column are displaced relative to each other responsive to seismic force.

2. The seismic force response controlled frame of claim 1, including an outer wall and beams arranged on lower stories of said multi-storied frame interconnecting said first column and said outer wall, wherein said frame is strengthened against seismic force deformation.

3. The multi-storied frame building of claim 1, wherein said first column is a wall column and said second column is a connection column.

4. In a multi-storied frame building, a seismic force response controlled frame, comprising:

a pair of wall columns, each having a top connected to a wall girder cantilevered horizontally from said top, the wall girders of said pair of wall columns having opposed tip ends; and a seismic response control apparatus connected between said tip ends of said wall girders to control the displacement of said tip ends by generating damping force when said tip ends of said wall girders are displaced relative to each other.

5. The seismic force response controlled frame of claim 4, including an outer wall and beams arranged on lower stories of said multi-storied building interconnecting said wall column and an outer wall.

6. In a multi-storied frame building having a central core section comprising a plurality of seismic force response controlled frames arrayed to form a hollow core, each of said frames including a first member connected to a cantilevered wall girder having a tip end horizontally extending beyond said first member, a second member spaced from and co-planar with said wall girder; and a seismic response control apparatus connected between said tip end of said cantilevered wall girder and said second member to damp displacement of said tip end of said wall girder by generating damping force when said tip end of said wall girder and said second member are displaced relative to each other responsive to seismic force.

7. The device of claim 6, wherein said first member is a vertical wall column having a top upon which said cantilevered wall girder is supported, and said second member is a connection column in vertical alignment beneath said tip end of said wall girder.

8. The device of claim 6, wherein said frames are arrayed to form a triangular core.

9. The device of claim 6, wherein said frames are arrayed to form a quadrahedral core.

10. The device of claim 6, wherein said frames are arrayed to form a polyhedral core.

11. The device of claim 6, including access means to said core from one or more stories of said multi-storied frame building.

12. The device of claim 6, wherein said wall girder is cantilevered in a plurality of directions from said first member to provide a plurality of tip ends; a second member erected in alignment with each of said tip ends; and a seismic response control apparatus connected between each of said tip ends of said wall girder and said second members to damp displacement of said tip ends of said wall girder by generating damping forces when said tip ends of said wall girder and adjacent said second members are displaced relative to each other responsive to seismic force.

13. The device of claim 12, wherein said wall girder is linear to provide two tip ends.

14. The device of claim 12, wherein said wall girder is L-shaped to provide two tip ends.

15. The device of claim 12, wherein said wall girder is V-shaped to provide two tip ends.

16. The device of claim 12, wherein said wall girder is of bifurcated L-shaped configuration to provide three tip ends.

17. The device of claim 12, wherein said wall girder is T-shaped to provide three tip ends.

18. The device of claim 12, wherein said wall girder is of cruciform configuration to provide four tip ends.

19. The device of claim 12, wherein said wall girder is channel shaped to provide four tip ends.

20. The device of claim 12, wherein said girders are bi-level.

21. The device of claim 12, wherein said girders are multi-level.

* * * * *